United States Patent [19]

Panasewicz et al.

[11] Patent Number: 4,789,017

[45] Date of Patent: Dec. 6, 1988

[54] FUNNEL WITH STORAGE SYSTEM

[76] Inventors: Anton Panasewicz, 6428 Westminster Dr., Parma, Ohio 44129; Dale Panasewicz, 11600 Johnson Dr., Parma, Ohio 44130

[21] Appl. No.: 109,735

[22] Filed: Oct. 19, 1987

[51] Int. Cl.[4] ..... B67B 7/28; B67C 11/00

[52] U.S. Cl. ..... 141/342; 141/86; 141/311 R; 141/329; 141/339; 141/337; 7/151; 30/400; 248/94; 211/71

[58] Field of Search ..... 141/98, 86–88, 141/331–335, 345, 311 A, 329, 330, 105, 106; 206/320, 216; 248/94, 75, 89, 318; 211/71, 74, 79; 30/400; 7/151, 158; 222/81, 83, 108, 460

[56] References Cited

U.S. PATENT DOCUMENTS

| | | | |
|---|---|---|---|
| 573,333 | 12/1896 | Krimmel | 141/339 |
| 2,187,974 | 1/1940 | Johnson | 141/340 |
| 2,324,655 | 7/1943 | Tozer | 248/94 |
| 3,654,969 | 4/1972 | Vazquez et al. | 141/106 |
| 4,112,984 | 9/1978 | Guglia et al. | 141/98 |
| 4,267,945 | 5/1981 | Maynard, Jr. | 141/330 X |
| 4,600,125 | 7/1986 | Maynard, Jr. | 141/331 X |
| 4,706,719 | 11/1987 | Eversdijk | 141/98 |
| 4,706,720 | 11/1987 | Pattison et al. | 141/327 |

FOREIGN PATENT DOCUMENTS

| | | | |
|---|---|---|---|
| 557434 | 8/1923 | France | 141/341 |
| 6601205 | 8/1967 | Netherlands | 222/108 |
| 318365 | 12/1956 | Switzerland | 222/81 |

*Primary Examiner*—Henry J. Recla
*Assistant Examiner*—Ernest G. Cusick
*Attorney, Agent, or Firm*—Donald A. Bergquist

[57] ABSTRACT

This invention relates generally to funnels; more specifically it relates to funnels intended for use with fluids used in engine compartments, such as in transportation vehicles. Examples of such fluids are crankcase oil, transmission fluid, anti-freeze or other coolant fluids, brake fluid, and power steering fluid. The invention is a liquid transfer system including a funnel with a dust cover that may be stored on a funnel support while the funnel is in use and that may include a piercing tool on its inner surface capable of puncturing the lids of containers used with the funnel. Also claimed is such a liquid transfer system including a support that holds the funnel in a vertical position during storage, a drip catcher, and an axially extendible and compressible spout.

6 Claims, 2 Drawing Sheets

FUNNEL WITH STORAGE SYSTEM

BACKGROUND OF THE INVENTION

This invention deals generally with funnels; more specifically it relates to funnels intended for use with liquids used in engine compartments, such as in transportation vehicles. Examples of such liquids are crankcase oil, transmission fluid, anti-freeze or other coolant fluids, brake fluid, and power steering fluid. The invention is a funnel storage system comprising a funnel, funnel support means, drip catcher, dust cover, which cover may have a piercing tool, and a support means incorporated in the funnel receiving chamber to help position a liquid container for containerized liquids used with the funnel.

Because of the growing complexity of engine compartments, especially those in transport vehicles, wherein space is often at a premium, it is often necessary to use long-stemmed funnels to add the necessary lubricants and other fluids to the various parts of the engine and the accessories powered thereby. A number of such funnels have been described in the patent literature and elsewhere.

The conscientious mechanic is careful to avoid cross-contamination of the various liquids, either by carefully cleaning the funnel he uses, or by using a variety of funnels, each intended for use with a single liquid or type of fluid. In following the latter course of action, the prudent mechanic will want to store his various funnels in a way that will prevent both their contamination by dust and dirt and their contaminating the workplace with drips and puddles. Such drips and puddles, in addition to being potential safety hazards for the mechanic, can present alluring toxic drinks for pets who may frequent the garage.

For these reasons, such a conscientious mechanic would find useful a collection of funnels, each of which can be stored without becoming contaminated with other liquids or dust or dirt. The funnel would have means to prevent drips, dribbles, and puddles from contaminating the floor as the funnel is stored and as it is being put into its storage location. Also, to prevent excess liquid from wetting the outside of its container when it is inverted in the receptacle portion of the funnel, thereby creating another drip or dribble source, a stop should be provided in said receptacle portion to keep the inverted can from contacting any pool of liquid that might accumulate in the receptacle.

It is therefore the object of this invention to provide such a funnel and to provide such a funnel combined with a storage means, a drip catcher, a dust cover, and a means that provides a stop for the inverted liquid container that may be used therewith.

It is an object of this invention to provide a funnel having a flexible stem that collapses in an axial direction for compact storage of the funnel.

It is an object of this invention to provide a funnel with means for storing it in an upright position with a drip catcher to catch liquid remaining in the funnel after its use and a dust cover to prevent dust and dirt contamination.

It is an object of this invention to provide such a funnel wherein the means allowing for supporting the funnel for storage thereof also provides support for a liquid container inverted in the receptacle of the funnel for draining said liquid into the funnel.

DESCRIPTION OF THE PREFERRED EMBODIMENT

This invention will best be understood by referring to the attached figures, wherein like numbers refer to the same part throughout the various views.

Figure 1:
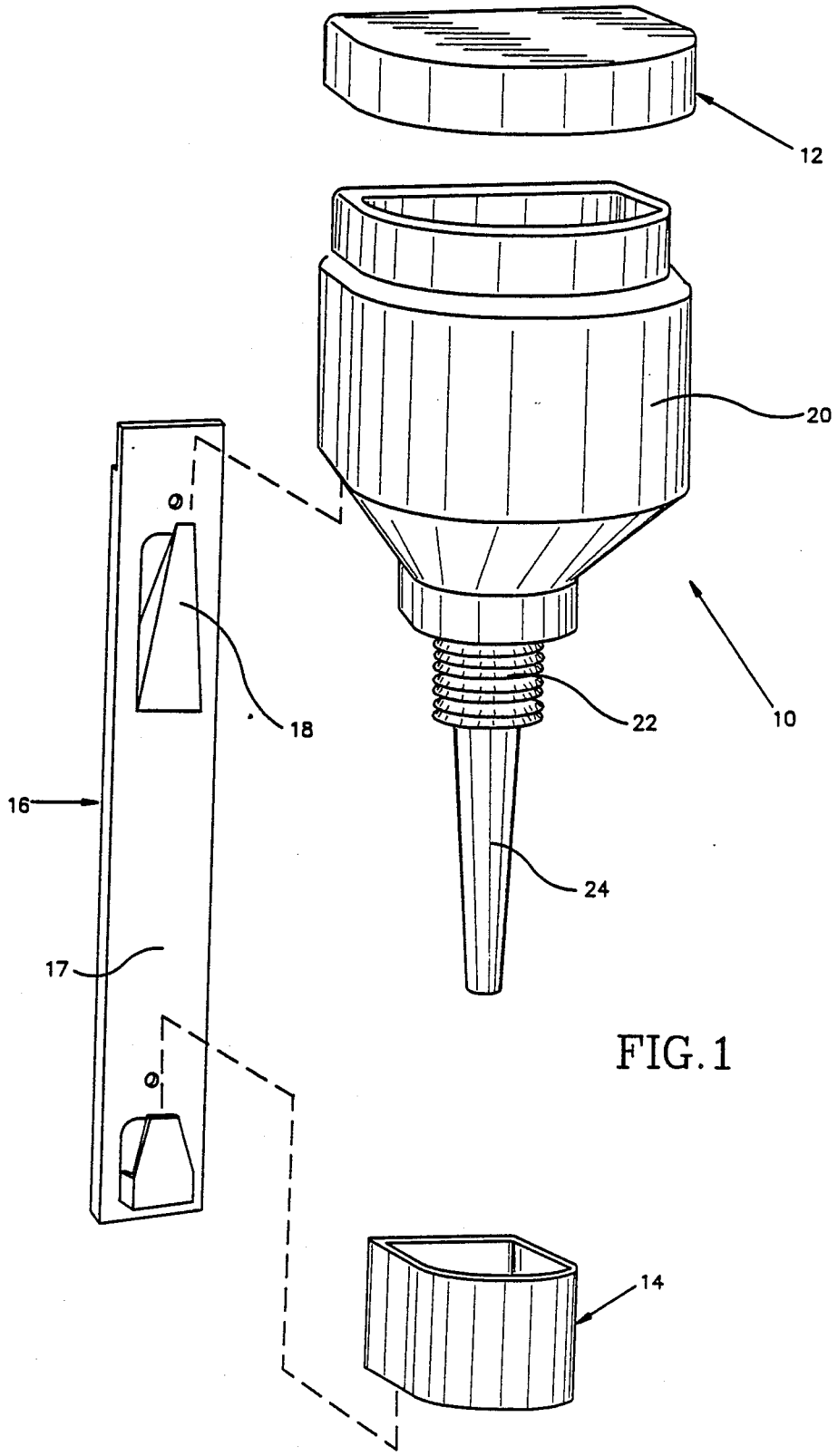
FIG. 1 illustrates the funnel of this invention in its storage mode in exploded perspective view.

FIG. 1 illustrates the pouring system of this invention in an exploded view of its storage mode. The system shown comprises a single funnel 10, a cover 12 therefor, a drip catcher 14, and an example of a support means 16 upon which the aforementioned parts are supported for storage with said funnel held upright.

The example support means comprises a plate 17 for attachment to a substantially vertical surface and a projection 18 from said plate, which projection is the support means for the funnel 10. The drip catcher 14 may be mounted below the second pouring spout 24 of the stored funnel and in the best mode is removable from the support means 16 for cleaning or for using the drip catcher to catch drips while carrying the funnel from its point of use to its point of storage. It is obvious that a single support means could be manufactured that would support two or more such funnels.

The funnel 10 comprises a receiving chamber 20, a first pouring spout portion 22 that in the best mode is axially extensible and flexible, and a second pouring spout portion 24 that is tapered for adapting the funnel to fit openings of various sizes. In the best mode first pouring spout portion 22 of the funnel is compressed in the axial direction to conserve space in the storage mode.

Figure 2:
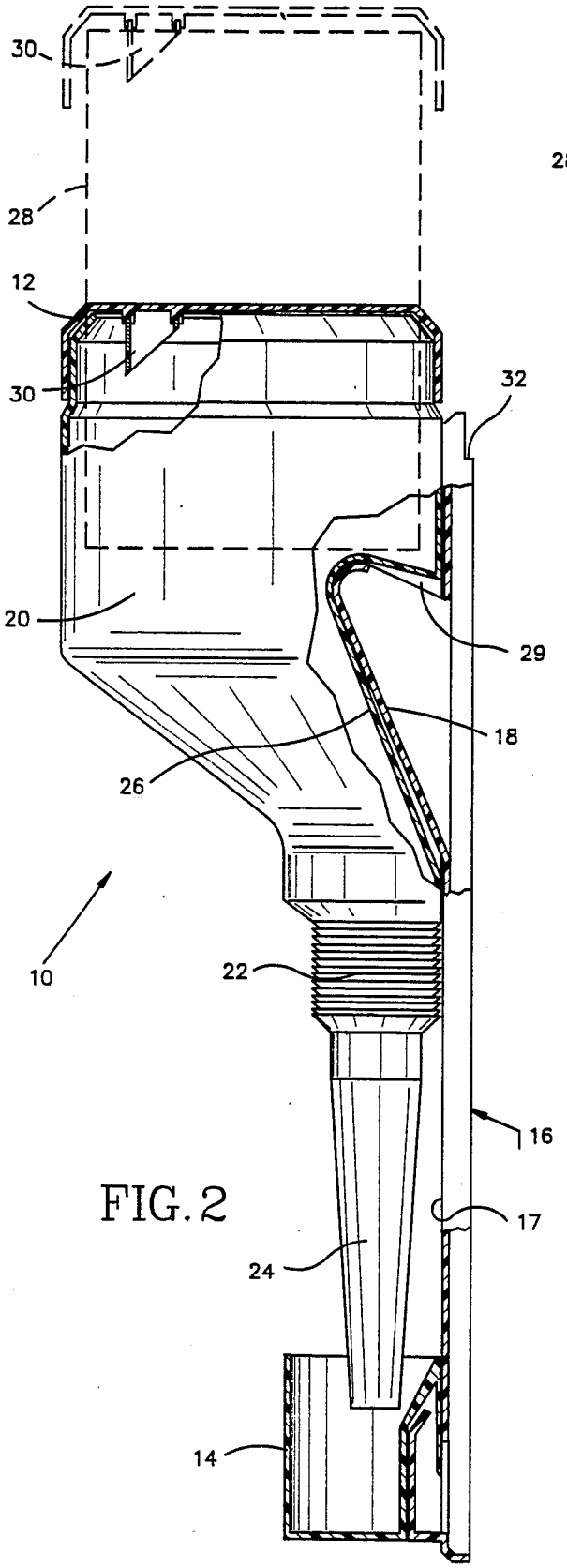
FIG. 2 shows a partial cutaway view of the funnel of this invention in its storage mode.

The receiving chamber 20 comprises a structure in the wall thereof, shown in FIG. 2, that may serve a dual purpose. The structure appears on the inner surface of the chamber as a projection from the wall and in the best mode the same structure appears on the outer surface as a cavity in the wall of the receiving chamber.

The projection 26 toward the interior of the receiving chamber acts as an internal container support means for supporting a container of liquid generally in the position shown in phantom lines as 28, which liquid is to be delivered by using the funnel. Note, however, that the can 28 is not usually present in the storage mode or when the funnel 10 is mounted on the support means 16 as in FIG. 2, but usually is present only in the use mode as in FIG. 3.

In the best mode, as is shown in the figures, the cavity 29 in the outer wall of the receiving chamber cooperatively engages the protection 18 to support the funnel on the support means during storage. The specific features of the funnel-supporting projection and the cooperating wall cavity that is simultaneously the internal container support means are presented as an example of one design choice. Other designs for funnel-supporting means must be considered obvious extensions of the technology taught herein. By providing a good mating fit between the supporting projection and the funnel, one is assured that the support is stable and the support of the funnel will not be compromised if the stored funnel is bumped or struck or if the supporting bracket is on a moving vehicle or cart.

The cover 12 for the funnel is made to fit the open end of the receiving chamber 20 to protect it from receiving and holding dust and dirt. In the best mode, as presented in the figures, the rim of the open end of the receiving chamber is protected by side walls of the cover. Thus, the rim will not collect dust and dirt that might substantially contaminate the interior of the funnel.

In the best mode, a piercing tool 30 is mounted inside the cover 12 to provide for opening a container holding containerized liquid. Once the opened can is inverted in the receiving chamber, the bottom of the can may also be pierced, as is shown with phantom lines in FIG. 2, to provide an atmospheric vent to more quickly transfer the liquid.

The piercing tool of FIG. 2 comprises an obliquely truncated hollow circular cylindrical shape which is fixedly attached to the inner surface of the cover, its axis substantially normal to the general plane of the cover. This piercing tool is shown by way of a non-limiting example. Other, equally suitable piercing tools could be used. The piercing tool is preferrably shorter than the side walls of the cover for the funnel, thus protecting the sharp point of the piercing tool should the cover be laid on a surface.

As can be seen in FIG. 2, provision may be made for the cover to be stored on the support means when the funnel is removed for use. For example, in the illustration, the side wall of the cover may be supported by recess 32 acting cooperatively with the surface upon which the support means is mounted. This provision for supporting the cover keeps it in its normal orientation so that dust and dirt cannot settle onto its internal surface to be transferred to the funnel when the funnel is returned.

Figure 3:
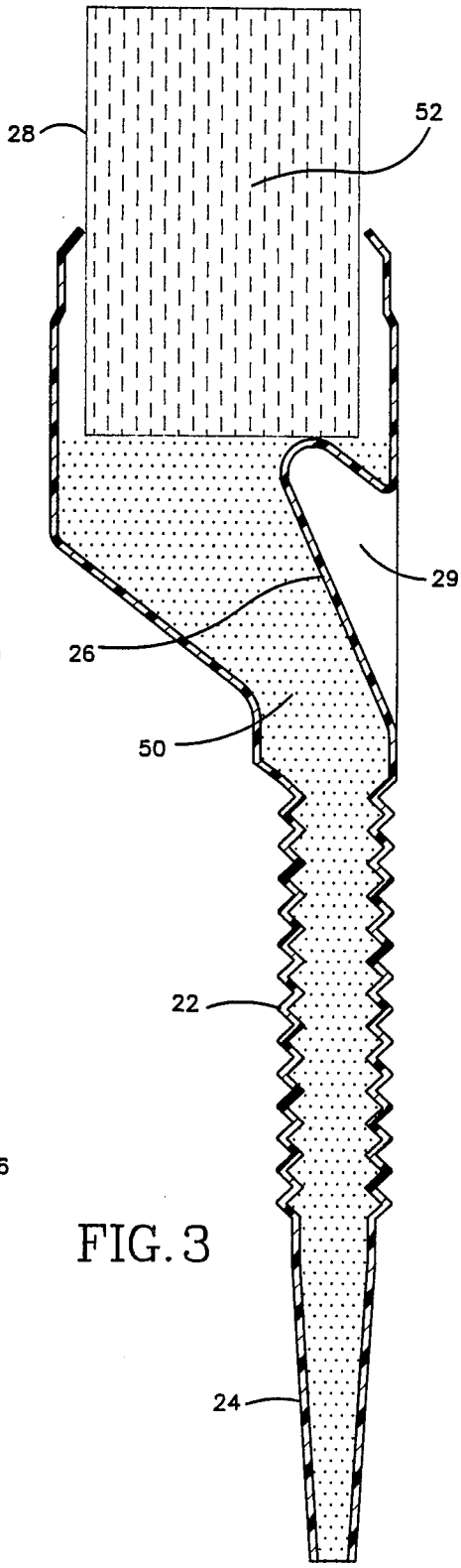
FIG. 3 shows a cutaway view of the funnel of this invention in its use mode.

Shown in FIG. 3 is the axial expansion of the first pouring spout 22 in the best mode of this invention. In the best mode, the first pouring spout 22 is made flexible and extendable as the tubing described in U.S. Pat. No. 3,908,704 "Corrugated Tubing".

In a preferred embodiment of the invention, the internal support means 26 is positioned such that the volume of the receiving chamber below the support means is greater than the volume of the typical container carrying the containerized liquid, usually a one-quart volume. Thus, when the container is inverted into the funnel 10 and rests upon the internal support means 26, the container is kept from contacting the pool of liquid created in the receiving chamber 20 of the funnel; thereby the support 26 helps to prevent unnecessary spillage and drippage that would be experienced if the container were to dip into the liquid.

FIG. 3 also illustrates the volume relationship between the receiving chamber volume below the internal support means and the volume of the liquid container to be used with the funnel in the said preferred embodiment of this invention. The receiving chamber volume being considered is the volume of the receiving chamber below the internal support means plus the volume of the first pouring spout in its storage mode plus the volume of the second pouring spout. This total volume in the funnel of the said preferred embodiment is larger than the volume of the containerized liquid container, which is usually a one-quart container. Referring to the figure, the funnel volume represented by the shaded area 50 in the funnel is larger than the container volume represented by the shaded area 52 in the container but with the second pouring spout compressed. In the best mode, the ratio of funnel volume to container volume is not just over 1.00, but a safety margin is included to allow for tilting of the container within the funnel and for tilting of the total container-funnel assemblage. A said ratio ranging from 1.05 to 1.10 is most desirable, but ratios as high as 1.20 or even greater, might be used with great success. The figure also illustrates once more the way the internal support functions to support the inverted liquid container.

Having thus described our invention in sufficient detail that its article may be reproduced by one skilled in the art, the invention that we claim is to be limited in scope only by the claims appended hereto.

We claim:

1. A liquid transfer system of a type principally designed for containerized liquids; said system comprising a funnel, comprising a receiving chamber having an open end and sidewalls capable of receiving a liquid container, said funnel also comprising a pouring spout connected to said receiving chamber; said system also comprising a dust cover to keep dust and dirt from entering the receiving chamber of said funnel during storage thereof; wherein the improvement is that said dust cover includes on its internal surface a piercing tool capable of puncturing the lids of containers for said containerized liquids, such containers as cans of motor oil or cans of automatic transmission fluid, for examples.

2. A liquid transfer system of a type principally designed for containerized liquids; said system comprising a funnel, comprising a receiving chamber having an open end and sidewalls capable of receiving a liquid container, said fluid also comprising a pouring spout connected to said receiving chamber; said system also comprising a dust cover to keep dust and dirt from entering the receiving chamber of said funnel during storage thereof; said system also comprising a funnel support means capable of supporting said funnel in a stable, substantially upright orientation for storage thereof, said funnel support means may be mounted on a vertical surface, such as a wall, partition, a work bench, or a cart, for examples; wherein the improvement is that said dust cover may be removably attached to said funnel support means for storage while said funnel is in use.

3. The liquid transfer system of claim 1 also comprising a funnel support means capable of supporting said funnel in a stable, substantially upright orientation for storage thereof, said funnel support means may be mounted on a vertical surface, such as a wall, partition, a work bench, or a cart, for example.

4. The liquid transfer system of claim 2 or 3 in combination with a drip catcher attached to said funnel support means in a position below said funnel to catch liquid remaining in said funnel after use thereof, said drip catcher may be removably attached to said funnel support means.

5. The liquid transfer system described in claim 1, 2, 3 wherein said pouring spout is flexible and axially extendible for use and axially compressible for storage of the funnel.

6. A liquid transfer system of a type principally designed for containerized liquids; said system comprising a funnel, comprising a receiving chamber having an open end and sidewalls capable of receiving a liquid container, said funnel also comprising a pouring spout connected to said receiving chamber; said system also comprising a funnel support means capable of supporting said funnel in a stable, substantially upright orientation for storage thereof, said funnel support means may be mounted on a vertical surface, such as a wall, partition, a work bench, or a cart, for examples; said system also comprising a dust cover to keep dust and dirt from entering the receiving chamber of said funnel during storage thereof, said dust cover including on its internal surface a piercing tool capable of puncturing the lids of containers for said containerized liquids, such containers as cans of motor oil or cans or automatic transmission fluid, for examples, and said dust cover may be removably attached to said funnel support means for storage while said funnel is in use; said system also comprising a drip catched attached to said funnel support means in a position below said funnel to catch liquid remaining in said funnel after use thereof, said drip catcher may be removably attached to said funnel support means; and wherein said pouring spout is flexible and axially extendible for use and axially compressible for storage of the funnel.

* * * * *

UNITED STATES PATENT AND TRADEMARK OFFICE

CERTIFICATE OF CORRECTION

PATENT NO. : 4,789,017

DATED : Dec. 6, 1988

INVENTOR(S) : Anton Panasewicz and Dale Panasewicz

It is certified that error appears in the above-identified patent and that said Letters Patent is hereby corrected as shown below:

Column 4, line 59, claim 5, after "2," should be --or--.

Signed and Sealed this

Sixteenth Day of May, 1989

*Attest:*

*Attesting Officer*

DONALD J. QUIGG

*Commissioner of Patents and Trademarks*